US007764010B2

(12) United States Patent
Choi et al.

(10) Patent No.: US 7,764,010 B2
(45) Date of Patent: Jul. 27, 2010

(54) ELECTRON EMISSION DEVICE, ELECTRON EMISSION DISPLAY APPARATUS HAVING THE SAME, AND METHOD OF MANUFACTURING THE SAME

(75) Inventors: Young-Chul Choi, Suwon-si (KR); Jong-Hwan Park, Suwon-si (KR); Deok-Hyeon Choe, Suwon-si (KR)

(73) Assignee: Samsung SDI Co., Ltd., Giheung-gu, Yongin-si, Gyeonggi-do (KR)

( * ) Notice: Subject to any disclaimer, the term of this patent is extended or adjusted under 35 U.S.C. 154(b) by 902 days.

(21) Appl. No.: 11/524,963

(22) Filed: Sep. 22, 2006

(65) Prior Publication Data

US 2010/0164343 A1 Jul. 1, 2010

(30) Foreign Application Priority Data

Oct. 4, 2005 (KR) ..... 10-2005-0093117

(51) Int. Cl.
*H01J 1/304* (2006.01)

(52) U.S. Cl. ..... 313/497; 313/495; 313/310; 445/46; 445/51

(58) Field of Classification Search ..... 313/495–497, 313/309–310; 445/46, 51
See application file for complete search history.

(56) References Cited

U.S. PATENT DOCUMENTS 6,255,771 B1 * 7/2001 Jones et al. ..... 313/495
6,563,260 B1 5/2003 Yamamoto et al.
6,699,642 B2 * 3/2004 Chung et al. ..... 430/313
7,365,632 B2 * 4/2008 Bertin et al. ..... 338/195
2007/0236325 A1 * 10/2007 Bertin et al. ..... 338/195

FOREIGN PATENT DOCUMENTS

| | | |
|---|---|---|
| JP | 2000-123713 | 4/2000 |
| JP | 2000-223012 | 8/2000 |
| JP | 2000-340098 | 12/2000 |
| JP | 2001-195972 | 7/2001 |
| JP | 2002-184300 | 6/2002 |
| JP | 2004-002409 | 1/2004 |
| JP | 2005-194180 | 7/2005 |
| WO | 02063693 A1 | 8/2002 |

OTHER PUBLICATIONS

Transmittal letter, along with a Japanese Office action issued on Jun. 16, 2009 in Applicant's corresponding Japanese Patent Application No. 2006-197468.
Office action from Japanese patent Office issued in Applicant's corresponding Japanese Patent Application No. 2006-197468, and its Request for Entry of the Accompanying Office Action.

* cited by examiner

*Primary Examiner*—Karabi Guharay
(74) *Attorney, Agent, or Firm*—Robert E. Bushnell, Esq.

(57) ABSTRACT

An electron emission device that can uniformly emit electrons and has low manufacturing costs, a display apparatus having improved pixel uniformity by using the electron emission device, and a method of manufacturing the electron emission device, wherein the electron emission device includes a first substrate, a cathode and an electron emission source disposed on the first substrate, a gate electrode electrically insulated from the cathode, an insulating layer interposed between the cathode and the gate electrode to insulate the cathode from the gate electrode, and a resistance layer that contacts the cathode and includes semiconductive carbon nanotubes (CNTs).

20 Claims, 5 Drawing Sheets

ELECTRON EMISSION DEVICE, ELECTRON EMISSION DISPLAY APPARATUS HAVING THE SAME, AND METHOD OF MANUFACTURING THE SAME

CROSS-REFERENCE TO RELATED PATENT APPLICATION AND CLAIM OF PRIORITY

This application claims the benefit of Korean Patent Application No. 10-2005-0093117, filed on Oct. 4, 2005, in the Korean Intellectual Property Office, the disclosure of which is incorporated herein in its entirety by reference.

BACKGROUND OF THE INVENTION

1. Field of the Invention

The present invention relates to an electron emission device, an electron emission display apparatus that uses the electron emission device, and a method of manufacturing the same, and more particularly, to an electron emission device having a structure in which a voltage applied to an electron emission source is uniformly distributed, an electron emission display apparatus having the electron emission device to increase brightness uniformity of pixels, and a method of manufacturing the same.

2. Description of the Related Art

Generally, electron emission devices use a thermal cathode or a cold cathode as an electron emission source. Electron emission devices that use the cold cathode method include field emitter array (FEA) type devices, surface conduction emitter (SCE) type devices, metal insulator metal (MIM) type devices, metal insulator semiconductor (MIS) type devices, ballistic electron surface emitting (BSE) type devices, etc.

A field emitter array type electron emission device uses the principle that, when a material having a low work function or a high β function is used as an electron emission source, the material readily emits electron in a vacuum due to electric potential. Devices that employ a tapered tip structure formed of, for example, Mo, Si as a main component, a carbon group material such as graphite, diamond like carbon (DLC), etc., or a nano structure such as nanotubes, nano wires, etc., have been developed.

In a surface conduction emitter type electron emission device, an electron emission source includes a conductive thin film having micro cracks between first and second electrodes facing each other on a substrate. The electron emission device makes use of the principle that electrons are emitted from the micro cracks which are electron emission sources, when a current flows on the surface of the conductive thin film by applying a voltage to the electrodes.

The metal insulator metal type electron emission devices and metal insulator semiconductor type electron emission devices make use of the principle of emitting electrons that, after the MIM and MIS type electron emission devices respectively form a metal-dielectric layer-metal (MIM type) structure and a metal-dielectric layer-semiconductor (MIS type) structure, when a voltage is applied to two metals having a dielectric layer therebetween or to a metal and a semiconductor, electrons migrate from the metal or the semiconductor having a high electron potential to the metal having a low electron potential.

A ballistic electron surface emitting type electron emission device includes an electron emission source making use of a principle that electrons travel without scattering when the size of a semiconductor is smaller than a mean-free-path of electrons in the semiconductor. To form the electron emission source, an electron supply layer formed of a metal or a semiconductor is formed on an ohmic electrode, and an insulating layer and a metal thin film are formed on the electron supply layer. When a voltage is applied between the ohmic electrode and the metal thin film, the electron emission source emits electrons.

The field emitter array type electron emission devices can be classified into top gate devices and bottom gate devices according to the location of a cathode and a gate electrode, and can be classified into diodes, triodes, tetrodes, etc. according to the number of electrodes they include.

The conventional electron emission display apparatus includes an electron emission device and a front panel, which are located parallel to each other and form a vacuum space, and a spacer that maintains a gap between the electron emission device and the front panel.

The electron emission device includes a first substrate, a plurality of gate electrodes and a plurality of cathodes crossing the gate electrodes on the first substrate, and an insulating layer which is located between the gate electrodes and the cathodes and electrically insulates the gate electrodes from the cathodes.

A plurality of electron emission holes are formed on regions where the gate electrodes cross the cathodes. An electron emission source is formed in each of the electron emission holes.

The front panel includes a second substrate, an anode located on the lower surface of the second substrate, and a plurality of phosphor layers located on the lower surface of the anode.

A display apparatus that displays an image using a FEA type electron emission device often has non-uniform brightness between pixels which may occur due to variation in the voltages applied to respective electron emission source. The non-uniformity in brightness between pixels greatly impairs the quality of the image, and thus, the non-uniformity in brightness of pixels must be prevented. Accordingly, there is a need to solve the problem of non-uniformity of pixels.

SUMMARY OF THE INVENTION

The present invention provides an electron emission device that can uniformly emit electrons and can be simply manufactured at a reduced cost, and a display apparatus having improved uniform brightness of pixels using the electron emission device.

The present invention also provides a simple method of manufacturing an electron emission device at a reduced cost.

According to an aspect of the present invention, there is provided an electron emission device including: a first substrate; a cathode formed on the first substrate; a gate electrode electrically insulated from the cathode; an insulating layer formed between the cathode and the gate electrode to insulate the cathode from the gate electrode, the gate electrode and the insulating layer having an electron emission hole; an electron emission source formed in the electron emission hole through which electrons emitted from the electron emission source go; and a resistance layer that contacts the cathode and includes semiconductive carbon nanotubes (CNTs) as a main component.

The cathode and the gate electrode may cross each other.

The resistance layer may be interposed between the electron emission source and the cathode.

Alternatively, the resistance layer may contact lateral sides of the electron emission source. Preferably, the cathode is formed on a portion of the first substrate, the electron emission source is formed on a portion of the cathode, and the resistance layer is formed on the first substrate to cover the cathode and contacts the lateral sides of the electron emission source.

According to an aspect of the present invention, there is provided an electron emission display apparatus including: a first substrate; a plurality of cathodes formed on the first substrate; a plurality of gate electrodes crossing the cathodes; an insulating layer interposed between the cathodes and the gate electrodes to insulate the cathodes from the gate electrodes; an electron emission source disposed in an electron emission hole formed in regions where the cathodes and the gate electrodes cross each other; a resistance layer which contacts both the electron emission source and the cathodes and includes semiconductive carbon nanotubes as a main component; and a second substrate disposed substantially parallel to the first substrate; an anode disposed on the second substrate; and a phosphor layer disposed on the anode.

The resistance layer may be interposed between the electron emission source and the cathode, or may contacts lateral sides of the electron emission source and the upper surface of the cathode.

The resistance layer may have a resistivity of $10^3$ to $10^5$ Ωcm.

The electron emission display apparatus may further comprise a second insulating layer covering the upper surface of the gate electrode and a focusing electrode disposed parallel to the gate electrode and insulated from the gate electrode by the second insulating layer.

According to an aspect of the present invention, there is provided a method of forming an electron emission device, including: forming a first substrate; forming a cathode on the first substrate; forming an insulating layer on the cathode; forming a gate electrode on the insulating layer; forming an electron emission hole in the gate electrode and the insulating layer; and forming a resistance layer comprising semiconductive carbon nanotubes as a main component to be contacted with the cathode and forming an electron emission source in the electron emission hole.

The formation of the electron emission hole may include forming a mask pattern having a predetermined thickness on the upper surface of the gate electrode using photoresist, and etching the gate electrode and the insulating layer using the mask pattern. The formation of the resistance layer and the formation of the electron emission source may include (a) preparing a carbon paste including semiconductive carbon nanotubes and conductive carbon nanotubes for forming the electron emission source and preparing a carbon paste including the semiconductive carbon nanotubes as a main component for forming the resistance layer, (b) coating the carbon paste for forming the resistance layer in the electron emission hole, (c) coating the carbon paste for forming the electron emission source on the carbon paste for forming the resistance layer, and (d) hardening the carbon paste for forming the electron emission source and the carbon paste for forming the resistance layer.

The carbon paste for forming the electron emission source and the carbon paste for forming the resistance layer each may include a photosensitive material, and the hardening of the carbon pastes includes doping a photoresist on the coated carbon pastes, selectively exposing the coated carbon pastes to light, and removing unhardened portion of the carbon pastes and the photoresist.

Preferably, a method of forming an electron emission device includes: (a) sequentially forming a substrate, a cathode, an insulating layer, and a gate electrode; (b) forming a mask pattern having a predetermined thickness on the upper surface of the gate electrode using photoresist; (c) forming an electron emission hole by partly etching the gate electrode, the insulating layer, and the cathode using the mask pattern; (d) preparing semiconductive carbon nanotubes and conductive carbon nanotubes respectively for forming an electron emission source and a resistance layer by separating the semiconductive carbon nanotubes from the conductive carbon nanotubes; (e) coating a carbon paste for forming the resistance layer comprising the semiconductive carbon nanotubes and a negative photosensitive material in the electron emission hole; (f) coating a carbon paste for forming the electron emission source comprising the conductive carbon nanotubes and a negative photosensitive material on the carbon paste for forming the resistance layer; (g) hardening the carbon pastes by selectively exposing the carbon pastes; and (h) removing unhardened portion of the carbon pastes and the photoresist.

The operations (e), (f), and (g) may be sequentially performed, and operation (g) may comprise to simultaneously hardening a portion of the carbon paste for forming the resistance layer and hardening a portion of the carbon paste for forming the electron emission source in one exposing process. After operation (e) is performed, operation (g) may be performed to selectively harden a portion of the carbon paste for forming the resistance layer, and after operation (f) is performed, operation (g) may be performed once more to selectively harden a portion of the carbon paste for forming the electron emission source.

The operation (d) may comprise: adding carbon nanotubes to a solution that contains nitronium ions ($NO_2^+$); breaking metallic carbon nanotubes by applying ultra sonic waves to the solution having the carbon nanotubes; and obtaining semiconductive carbon nanotubes by filtering the solution to which the ultra sonic wave treating is completed.

The method may further comprise controlling the resistivity of the resistance layer by controlling the content of the semiconductive carbon nanotubes in the carbon paste for forming the resistance layer.

BRIEF DESCRIPTION OF THE DRAWINGS

A more complete appreciation of the present invention, and many of the above and other features and advantages of the present invention, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
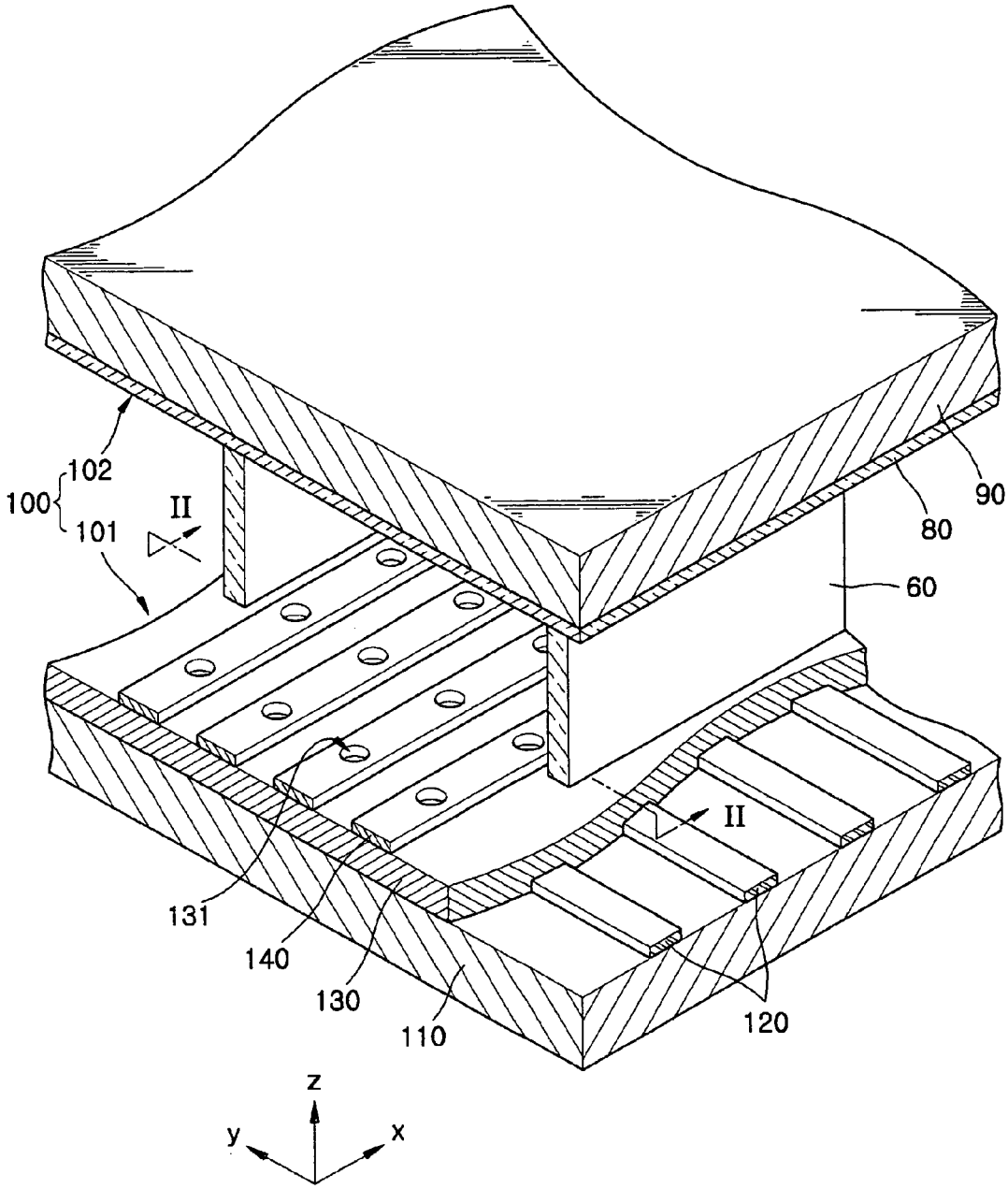
FIG. 1 is a partial perspective view for showing a general concept of a configuration of a electron emission device and a display apparatus.
Figure 2:
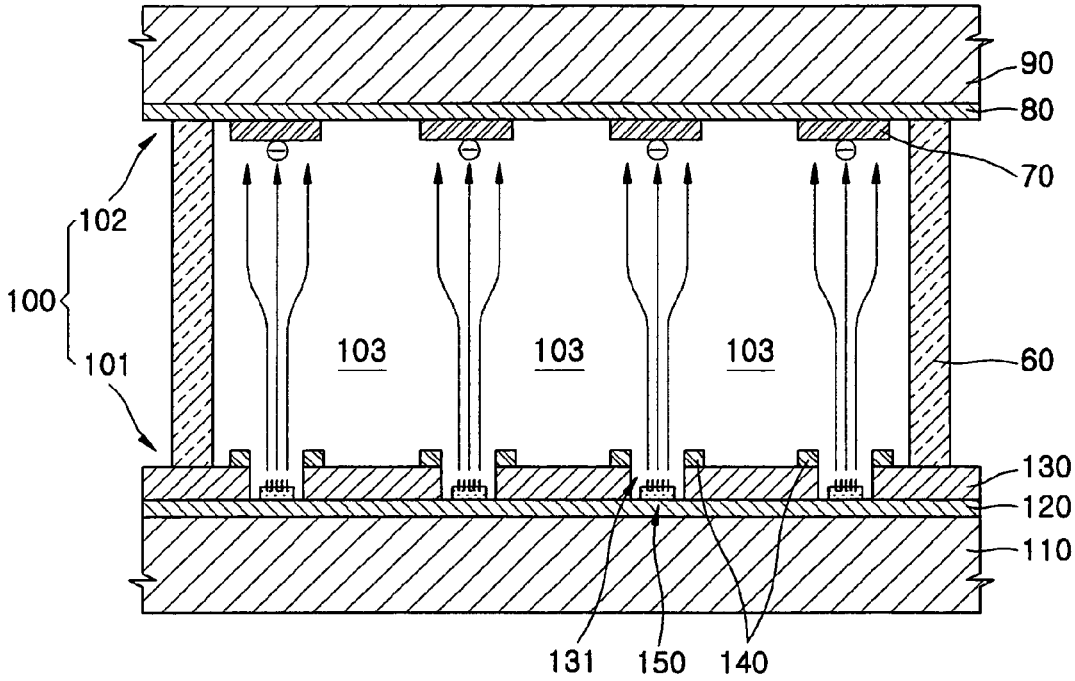
FIG. 2 is a cross-sectional view taken along line II-II of FIG. 1.

An example of a display apparatus that uses the field emitter array type electron emission device is depicted in FIGS. 1 and 2 for showing a general concept.

FIG. 1 is a partial perspective view of a top gate type electron emission display apparatus 100, and FIG. 2 is a cross-sectional view taken along line II-II of FIG. 1.

Referring to FIGS. 1 and 2, the electron emission display apparatus 100 includes an electron emission device 101 and a front panel 102, which are located parallel to each other and form a vacuum space 103, and a spacer 60 that maintains a gap between the electron emission device 101 and the front panel 102.

The electron emission device 101 includes a first substrate 110, a plurality of gate electrodes 140 and a plurality of cathodes 120 crossing the gate electrodes 140 on the first substrate 110, and an insulating layer 130 which is located between the gate electrodes 140 and the cathodes 120 and electrically insulates the gate electrodes 140 from the cathodes 120.

A plurality of electron emission holes 131 are formed on regions where the gate electrodes 140 cross the cathodes 120. An electron emission source 150 is formed in each of the electron emission holes 131.

The front panel 102 includes a second substrate 90, an anode 80 located on the lower surface of the second substrate 90, and a plurality of phosphor layers 70 located on the lower surface of the anode 80.

An electron emission device, a display apparatus having the electron emission device, and a method of manufacturing the electron emission device according to the present invention will now be described more fully with reference to the accompanying drawings in which exemplary embodiments of the invention are shown.

Figure 3:
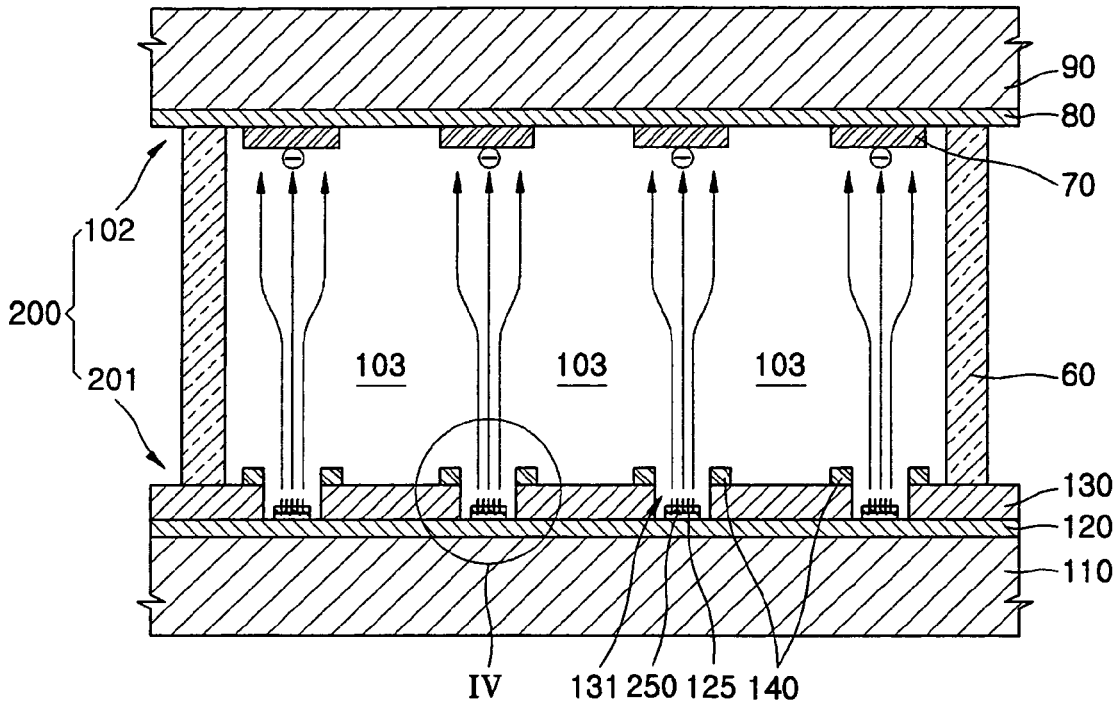
FIG. 3 is a cross-sectional view of a display apparatus including an electron emission device according to an embodiment of the present invention.
Figure 4:
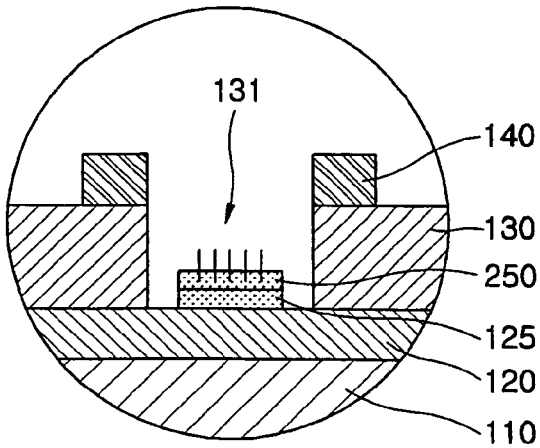
FIG. 4 is an enlarged view of portion IV of FIG. 3.

FIG. 3 is a cross-sectional view of a display apparatus 200 including an electron emission device 201 according to an embodiment of the present invention, and FIG. 4 is an enlarged view of portion IV of FIG. 3.

Referring to FIGS. 3 and 4, the electron emission device 201 includes a first substrate 110, a cathode 120, a gate electrode 140, a first insulating layer 130, an electron emission source 250, and a resistance layer 125.

The first substrate 110 can be a board member having a predetermined thickness, or a glass substrate formed of quartz glass, glass containing a small amount of impurity such as Na, plate glass, or glass coated with $SiO_2$, an aluminum oxide, or a ceramic. Also, if the display apparatus is a flexible display apparatus, the first substrate 110 can be formed of a flexible material.

The cathode 120 extends in one direction on the first substrate 110. The cathode 120 can be formed of a common electrically conductive material: for example, a metal such as Al, Ti, Cr, Ni, Au, Ag, Mo, W, Pt, Cu, Pd, etc. or an alloy of such metals; a printed conductive material made by mixing glass with a metal such as Pd, Ag, $RuO_2$, Pd—Ag, etc. or a metal oxide of such metals; a transparent conductive material such as $In_2O_3$, $SnO_2$, etc.; or a semiconductive material such as polycrystalline silicon, etc.

The gate electrode 140 is disposed above the cathode 120 having the first insulating layer 130 therebetween, and can be formed of a common electric conductive material similar to those indicated above for the cathode 120.

The first insulating layer 130 is interposed between the gate electrode 140 and the cathode 120 to prevent a short circuit between the gate electrode 140 and the cathode 120.

The electron emission source 250 is electrically connected to the cathode 120, and disposed below the gate electrode 140. The electron emission source 250 can be formed of any material that has low work function and high β function. Particularly, the electron emission source 250 may be formed of a carbon base material such as carbon nano tube (CNT), graphite, diamond, diamond like carbon, etc. Particularly, carbon nanotube is easily driven at a low voltage since carbon nanotube has a high electron emission characteristic. Therefore, carbon nanotube is suitable for a large screen display apparatus.

The resistance layer 125 is connected to both the electron emission source 250 and the cathode 120. Particularly, the resistance layer 125 may be interposed between the electron emission source 250 and the cathode 120, which simplifies a manufacturing process and allows a voltage to be uniformly applied to the electron emission source 250. That is, the resistance layer 125 reduces a voltage applied to the electron emission source 250. Accordingly, a voltage having a small deviation over the entire region of the electron emission source 250 can be applied. In addition, voltages applied to the respective electron emission sources 250 can have a small deviation.

The resistance layer 125 includes semiconductive carbon nanotube as a main component. In general, carbon nanotubes synthesized by using a metal catalyst include carbon nanotubes having semiconductive characteristics (semiconductive carbon nanotubes) and carbon nanotubes having conductive characteristics (conductive carbon nanotubes). The carbon nanotubes should be controlled to include more the semiconductive carbon nanotubes than the conductive carbon nanotubes. Of the synthesized carbon nanotubes, semiconductive carbon nanotubes are separated and used as a main raw material for the resistance layer 125. Preferably, the resistance layer 125 consists essentially of the semiconductive carbon nanotubes. A method to obtain the semiconductive carbon nanotubes will be described later.

The resistance layer 125 may have a resistivity between 1,0000 Ωcm and 100,0000 Ωcm. When the resistivity is less than 1,000 Ωcm, uniform emission of electrons from each of the electron emission sources 250, which could be obtained by applying a uniform voltage to the cathode 120 using the resistance layer 125, cannot be obtained. Accordingly, black spots on an image cannot be prevented and uniform light emission cannot be obtained. If the resistivity of the resistance layer 125 exceeds 100,0000 Ωcm, power consumption of the resistance layer is excessively high with no corresponding improvement in brightness uniformity.

The resistivity of the resistance layer 125 can be controlled by controlling the content of the semiconductive carbon nanotubes in the resistance layer 125. Also, the resistivity of the resistance layer 125 can be controlled by doping a portion of the semiconductive carbon nanotubes with a dopant.

To operate the electron emission device 201, a negative voltage is applied to the cathode 120 and a positive voltage is applied to the gate electrode 140.

The electron emission device 201 can be used for a display apparatus that realizes an image by generating visible light. The display apparatus 200 further includes a second substrate 90 parallel to the first substrate 110 of the electron emission device 201, an anode 80 disposed on the second substrate 90, and phosphor layers 70 disposed on the anode 80.

To display an image rather than to merely operate as a lamp for generating visible light, the cathode 120 and the gate electrode 140 may cross each other.

Electron emission holes 131 are formed in the regions where the gate electrodes 140 and the cathodes 120 cross each other, and the electron emission sources 250 are disposed in the electron emission holes 131.

The electron emission device 201 that includes the first substrate 110 and the front panel 102 that includes the second substrate 90 are separated a predetermined distance and face each other to form a light emission space 103. A plurality of spacers 60 are formed between the electron emission device 201 and the front panel 102 to maintain the gap therebetween. The spacers 60 can be formed of an insulating material.

Also, to form a vacuum in the light emission space 103, the perimeter of the light emission space 103 is sealed using glass frit, and air in the light emission space 103 is exhausted.

The operation of the electron emission display apparatus 200 will now be described.

To induce the emission of electrons from the electron emission source 250 disposed on the cathode 120, a negative voltage is applied to the cathode 120 and a positive voltage is applied to the gate electrode 140. Also, a strong positive voltage is applied to the anode 80 to accelerate the electrons traveling toward the anode 80. When the voltages are applied to the electrodes as described above, the electrons emitted from the electron emission source 250 travel toward the gate electrode 140 and are accelerated toward the anode 80. The accelerated electrons generate visible light by colliding with the phosphor layer 70 disposed on the anode 80.

The brightness uniformity of pixels and the image quality of the display apparatus 200 are improved since a voltage applied to the electron emission sources that constitute pixels is uniformly distributed by the resistance layer 125 used for the electron emission device 201.

A method of manufacturing an electron emission device according to an embodiment of the present invention will now be described. The method described herewith is only an example, and the present invention is not limited thereto.

A first substrate 110, a cathode 120, an insulating layer 130, and a gate electrode 140 are sequentially stacked to a predetermined thickness using respective materials for each of the elements. The stacking may be performed using a process such as screen printing.

Next, a mask pattern having a predetermined thickness is formed on the upper surface of the gate electrode 140. The mask pattern, which will be used for forming electron emission holes 131, can be formed through a photolithography process, that is, the mask pattern is formed using UV rays or an E-beam after a photoresist (PR) is coated on the upper surface of the gate electrode 140.

Next, the electron emission holes 131 are formed by etching the gate electrode 140, the insulating layer 130, and the cathode 120 using the mask pattern. The etching process can be wet etching using an etching solution, dry etching using a corrosive gas, or micro machining using an ion beam according to the materials comprising and the thicknesses of the gate electrode 140, the insulating layer 130, and the cathode 120.

Next, a carbon paste that includes a carbon material is formed. A carbon paste for forming a resistance layer 125 and a carbon paste for forming the electron emission source 250 are separately formed The carbon paste for forming the resistance layer 125 includes semiconductive carbon nanotubes. The carbon paste for forming the electron emission source 250 includes carbon nanotube powders, in which both semiconductive carbon nanotubes and conductive carbon nanotubes are mixed. The electron emission holes 131 are coated with the carbon paste for forming the resistance layer 125. Next, the carbon paste for forming the electron emission source 250 is coated on the carbon paste for forming the resistance layer 125. The coating process can be performed by screen printing.

Next, hardening processes for a portion of the carbon paste for forming the resistance layer 125 and a portion of the carbon paste for forming the electron emission source 250 are respectively performed.

A carbon paste that includes a photosensitive resin is hardened differently from a carbon paste that does not include a photosensitive resin. When the carbon paste includes the photosensitive resin, an exposure process is used. For example, when the carbon paste includes a negative photosensitive resin, since the negative photosensitive resin hardens when it is exposed to light, the negative photosensitive resin is coated with a photoresist using a photolithography process. Afterward, the resistance layer 125 and the electron emission source 250 can be formed by selectively radiating light to harden only a necessary portion of the carbon paste.

Next, after the exposure, the forming of the electron emission device 201 is completed by developing the resultant product to remove remaining an unhardened portion of carbon paste and the photoresist.

On the other hand, when the carbon paste does not include the photosensitive resin, the electron emission source 250 and the resistance layer 125 can be formed a photolithography process using an additional photoresist pattern. That is, after a photoresist pattern is formed using a photoresist film, the carbon paste is printed using the photoresist pattern.

The printed carbon paste is baked under an oxygen gas atmosphere or a nitrogen gas atmosphere containing 1000 ppm or less, for example, between 10 and 500 ppm of oxygen. Through the baking process under the oxygen gas atmosphere, the adhesive force of the carbon nanotubes of the carbon paste to the substrate is increased, a vehicle is evaporated, and other materials such as inorganic binders are melted and solidified contributing to the durability of the electron emission source 250.

The baking temperature can be determined in consideration of the vaporization temperature and time of the vehicle included in the carbon paste. For example, the baking temperature may be between 350 and 500° C., preferably 450° C. When the baking temperature is lower than 350° C., sufficient vaporization of the vehicle does not take place. When the baking temperature exceeds 500° C., manufacturing cost increases and there is a high possibility of deformation of the substrate.

If necessary, an activation process for the baked product is performed. In an embodiment of the activation process, after a solution that can be hardened to a film through the baking process, for example, a solution of an electron emission source surface treating agent containing a polyimide group polymer, is coated on the baked product, the solution-coated baked product is baked again. Afterward, a film formed by the baking process is exfoliated to erect the carbon nanotubes upward. In another embodiment of the activation process, an adhesion unit is formed on the surface of a roller driven by a predetermined diving force, and to activate the baked product, the surface of the baked product is pressed using the adhesion unit with a predetermined pressure. Through the activation process, nano-sized inorganic materials are erected upward from the surface of the electron emission source.

The carbon paste can further include a vehicle besides the carbon nanotubes for controlling the printability and viscosity thereof. The vehicle can be composed of a resin component and a solvent component.

The resin component can include, for example, at least one of a cellulose group resin such as ethylcellulose, nitrocellulose, etc.; an acryl group resin such as polyester acrylate, epoxy acrylate, urethane acrylate. etc.; and a vinyl group resin such as polyvinyl acetate, polyvinyl butyral, polyvinyl ether, etc., but the present invention is not limited thereto. Some of the aforementioned resin components can simultaneously serve as a photosensitive resin.

The solvent component can include terpineol, butyl carbitol (BC), butyl carbitol acetate (BCA), toluene, and texanol, and is preferably terpineol.

When the amount of the solvent component is too little or too much, the printability and flowability of the carbon paste are reduced. Particularly, when the amount of the vehicle is excessively high, the drying time of the carbon paste can be excessively long.

The carbon paste can further include one of a photosensitive resin, a photo initiator, and a filler, if necessary.

The photosensitive resin can be, for example, an acrylate group monomer, a benzophenon group monomer, an acetophenon group monomer, a thioxanthone group monomer, etc., and more specifically, epoxy acrylate, polyester acrylate, 2,4-diethyloxanthone, 2,2-dimethoxi-2-phenylacetophenon. etc., but the present invention is not limited thereto.

The photoinitiator initiates a cross linking with the photosensitive resin when the photosensitive resin is exposed to UV. A non-limiting example of the photoinitiator is benzophenon.

The filler increases conductivity when the nano-sized inorganic material does not have a sufficient adhesive force with the substrate, and non-limiting examples of the filler are Ag, Al, etc.

Up to now, the method of manufacturing the electron emission source 250 and a resistance layer 125 using a carbon paste has been described. However, the electron emission source 250 can be formed by using a chemical vapor deposition (CVD) growing method. However, it may be difficult to form the resistance layer 125 that includes semiconductive carbon nanotubes using the CVD growing method. Therefore, even if the electron emission source 250 is formed using the CVD growing method, the resistance layer 125 is preferably formed by printing a carbon paste after the carbon paste is prepared. The forming of both the electron emission source 250 and the resistance layer 125 by printing a carbon paste after the carbon paste is prepared may be advantageous for simplifying a manufacturing process.

A method of obtaining the semiconductive carbon nanotubes, which are the main component of the resistance layer 125, will now be described.

First, $NO_2SbF_6$ and $NO_2BF_4$ are added to a tetramethylene sulfone (TMS)/chloroform solution. Nitronium ions ($NO_2^+$) are present in the TMS/chloroform solution.

Next, a carbon nanotube powder in which a semiconductive material and a conductive material are mixed is added to the resulting solution. The solution having the carbon nanotube powder is stirred, or ultrasonic waves are applied to the solution. In this process, the metal carbon nanotubes are broken so that and the conductive carbon nanotubes are removed. Next, semiconductive carbon nanotubes can be obtained by filtering the solution.

A carbon paste is formed using the carbon nanotubes obtained in this way, and, in addition to the carbon paste, a conventional carbon paste having a mixture of the semiconductive material and the conductive material is formed.

Figure 5:
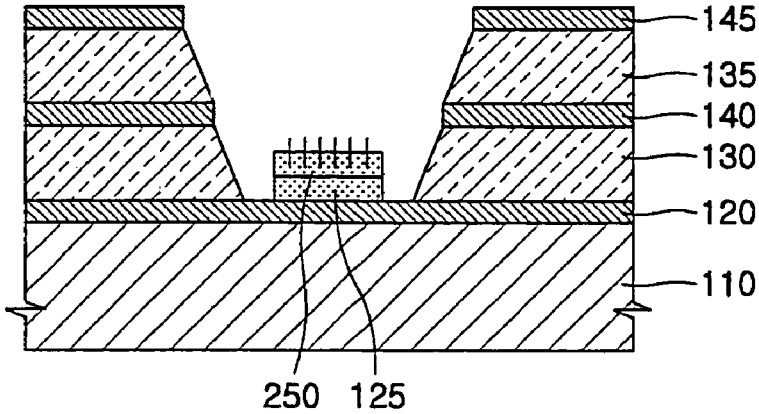
FIG. 5 is a cross-sectional view of a display apparatus including an electron emission device according to another embodiment of the present invention.

FIG. 5 is a cross-sectional view of a display apparatus including an electron emission device according to another embodiment of the present invention.

Referring to FIG. 5, the electron emission device 200 of the present embodiment further includes a second insulating layer 135 and a focusing electrode 145 in addition to the components of the electron emission device 200 depicted in FIG. 4.

The focusing electrode 145 is electrically insulated from the gate electrode 140 by the second insulating layer 135. Also, the focusing electrode 145 enables the electrons which are emitted from the electron emission source 250 to travel along a straight path toward the anode 80 of the front panel 102 depicted in FIG. 3. The focusing electrode 145 is formed of a material having high electrical conductivity like the material forming the cathode 120 and the gate electrode 140. When the electron emission device 200 further includes the focusing electrode 145, and the electron emission device 200 includes the resistance layer 125 formed of semiconductive carbon nanotubes, a voltage applied to the electron emission source 250 can be uniformly distributed, thereby enabling uniform electron emission from the electron emission source 250. Also, a display apparatus that employs the electron emission device 200 can further increase the brightness uniformity of pixels through the harmonization of electron focusing by the focusing electrode 145 with the uniform voltage obtained by the resistance layer 125. The resistivity of the resistance layer 125 can be controlled in the manufacturing process through the control of the semiconductive carbon nanotube content in the carbon paste for forming the resistance layer 125.

Figure 6:
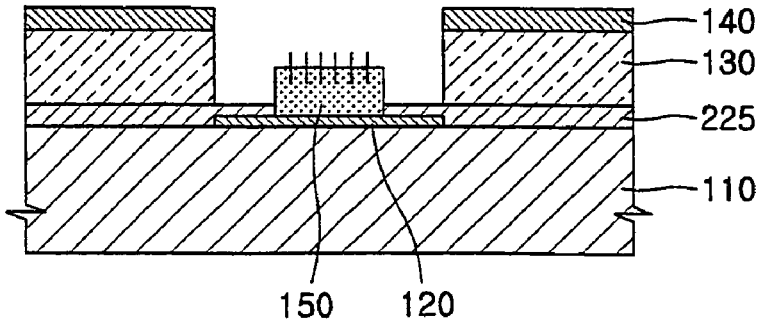
FIG. 6 is a cross-sectional view of a display apparatus including an electron emission device according to another embodiment of the present invention.
Figure 7:
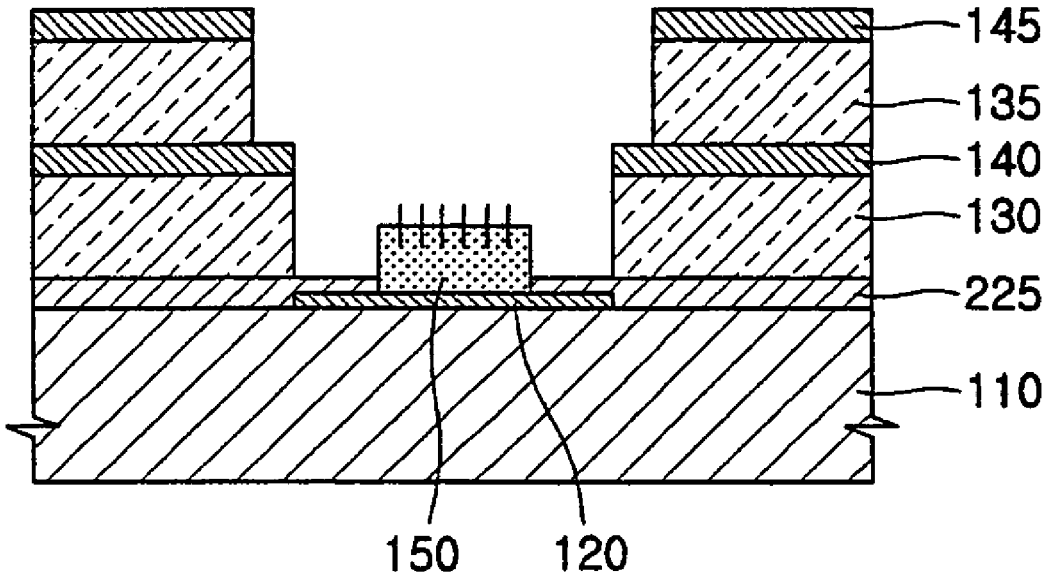
FIG. 7 is a cross-sectional view of a display apparatus including an electron emission device according to another embodiment of the present invention.

FIGS. 6 and 7 are cross-sectional views of a display apparatus including an electron emission device according to other embodiments of the present invention.

Referring to FIGS. 6 and 7, a difference in the electron emission device according to the present embodiments shown in FIGS. 6 and 7 from the electron emission device of FIGS. 4 and 5 is that a resistance layer 225 is not interposed between the electron emission source 150 and a cathode 120, but contacts the upper surface of the cathode 120 and the lateral surfaces of the electron emission source 150. Although the resistance layer 225 contacts the upper surface of the cathode 120 and the lateral surfaces of the electron emission source 150, a voltage applied to the cathode 120 is still uniformly applied to each of the electron emission sources 150. Also, the resistance layer 225 can be formed by printing a carbon paste for forming the resistance layer 225 after the carbon paste, which includes semiconductive carbon nanotubes, is prepared, and the resistivity of the resistance layer 225 can be controlled by controlling the semiconductive carbon nanotube content in the carbon paste for forming the resistance layer 225.

As described above, according to the present invention, a voltage applied to an electron emission source is uniformly distributed over the electron emission source, thereby enabling uniform electron emission from the electron emission source, and a display apparatus that employs the electron emission source can obtain uniform brightness of pixels.

The effect of uniform electron emission can further be enhanced by adding a focusing electrode and forming a resistance layer including semiconductive carbon nanotubes.

Also, the resistance layer can be formed using a conventional process for forming the electron emission source, since the resistance layer is formed of semiconductive carbon nanotubes, thereby simplifying the manufacturing process.

Also, since the process for forming the conventional electron emission source and the process for forming the resistance layer can be performed at the same time, the above mentioned effects can be obtained without significantly changing the manufacturing process.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electron emission device, comprising:

a first substrate;

a cathode formed on the first substrate;

a gate electrode electrically insulated from the cathode;

an insulating layer formed between the cathode and the gate electrode to insulate the cathode from the gate electrode, the gate electrode and the insulating layer having an electron emission hole;

an electron emission source formed in the electron emission hole through which electrons emitted from the electron emission source go; and a resistance layer contacting the cathode, the resistance layer comprising semiconductive carbon nanotubes as a main component.

2. The electron emission device of claim 1, wherein the resistance layer has a resistivity of $10^3$ to $10^5$ Ωcm.

3. The electron emission device of claim 1, wherein the resistance layer is interposed between the electron emission source and the cathode.

4. The electron emission device of claim 1, wherein the resistance layer contacts lateral sides of the electron emission source.

5. The electron emission device of claim 4, wherein the cathode is formed on a portion of the first substrate, the electron emission source is formed on a portion of the cathode, and the resistance layer is formed on the first substrate to cover the cathode and contacts the lateral sides of the electron emission source.

6. The electron emission device of claim 1, further comprising:

a second insulating layer covering the upper surface of the gate electrode; and a focusing electrode disposed parallel to the gate electrode and insulated from the gate electrode by the second insulating layer.

7. The electron emission device of claim 1, wherein the cathode and the gate electrode cross each other.

8. An electron emission display apparatus, comprising:

a first substrate;

a plurality of cathodes formed on the first substrate;

a plurality of gate electrodes crossing the cathodes;

an insulating layer interposed between the cathodes and the gate electrodes to insulate the cathodes from the gate electrodes;

an electron emission source disposed in an electron emission hole formed in regions where the cathode electrodes and the gate electrodes cross each other;

a resistance layer contacting both the electron emission source and the cathodes, the resistance layer comprising semiconductive carbon nanotubes as a main component;

a second substrate disposed substantially parallel to the first substrate;

an anode disposed on the second substrate; and a phosphor layer disposed on the anode.

9. The electron emission display apparatus of claim 8, wherein the resistance layer has a resistivity of $10^3$ to $10^5$ Ωcm.

10. The electron emission display apparatus of claim 8, wherein the resistance layer is interposed between the electron emission source and the cathodes.

11. The electron emission display apparatus of claim 8, wherein the resistance layer contacts lateral sides of the electron emission source.

12. The electron emission device of claim 11, wherein the cathode is formed on a portion of the first substrate, the electron emission source is formed on a portion of the cathode, and the resistance layer is formed on the first substrate to cover the cathode and contacts the lateral sides of the electron emission source.

13. The electron emission display apparatus of claim 8, further comprising:

a second insulating layer covering the upper surface of the gate electrode; and a focusing electrode disposed parallel to the gate electrode and insulated from the gate electrode by the second insulating layer.

14. A method of manufacturing an electron emission device, comprising:

forming a first substrate;

forming a cathode on the first substrate;

forming an insulating layer on the cathode;

forming a gate electrode on the insulating layer;

forming an electron emission hole in the gate electrode and the insulating layer; and forming a resistance layer comprising semiconductive carbon nanotubes as a main component to be contacted with the cathode and forming an electron emission source in the electron emission hole.

15. The method of claim 14, wherein the formation of the electron emission hole comprises forming a mask pattern having a predetermined thickness on the upper surface of the gate electrode using photoresist, and etching the gate electrode and the insulating layer using the mask pattern; and the formation of the resistance layer and the formation of the electron emission source comprises (a) preparing a carbon paste including semiconductive carbon nanotubes and conductive carbon nanotubes for forming the electron emission source and preparing a carbon paste including the semiconductive carbon nanotubes as a main component for forming the resistance layer, (b) coating the carbon paste for forming the resistance layer in the electron emission hole, (c) coating the carbon paste for forming the electron emission source on the carbon paste for forming the resistance layer, and (d) hardening the carbon paste for forming the electron emission source and the carbon paste for forming the resistance layer.

16. The method of claim 15, wherein the carbon paste for forming the electron emission source and the carbon paste for forming the resistance layer each includes a photosensitive material, and the hardening of the carbon pastes comprises doping a photoresist on the coated carbon pastes, selectively exposing the coated carbon pastes to light, and removing unhardened portion of the carbon pastes and the photoresist.

17. The method of claim 15, wherein the operations (b), (c), and (d) are sequentially performed, and the operation (d) comprises simultaneously hardening a portion of the carbon paste for forming the resistance layer and hardening a portion of the carbon paste for forming the electron emission source in one exposing process.

18. The method of claim 15, wherein, after the operation (b) is performed, the operation (d) is performed to selectively harden a portion of the carbon paste for forming the resistance layer; and after the operation (c) is performed, the operation (d) is performed once more to selectively harden a portion of the carbon paste for forming the electron emission source.

19. The method of claim 15, wherein the preparation of the carbon paste including the semiconductive carbon nanotubes comprises:

adding carbon nanotubes to a solution containing nitronium ions ($NO_2^+$);

breaking metallic carbon nanotubes by applying ultra sonic waves to the solution having the carbon nanotubes; and obtaining the semiconductive carbon nanotubes by filtering the solution to which the ultra sonic waves were applied.

20. The method of claim 15, further comprising controlling the resistivity of the resistance layer by controlling the content of the semiconductive carbon nanotubes in the carbon paste for forming the resistance layer.

* * * * *